United States Patent [19]

Riffe et al.

[11] Patent Number: 5,009,757

[45] Date of Patent: Apr. 23, 1991

[54] ELECTROCHEMICAL SYSTEM FOR THE PREVENTION OF FOULING ON STEEL STRUCTURES IN SEAWATER

[75] Inventors: William J. Riffe; Jack D. Carter, Jr., both of Morehead City, N.C.

[73] Assignee: Marine Environmental Research, Inc., Morehead City, N.C.

[21] Appl. No.: 548,214

[22] Filed: Jul. 5, 1990

Related U.S. Application Data

[63] Continuation of Ser. No. 145,275, Jan. 19, 1988.

[51] Int. Cl.[5] ..... C23F 13/00

[52] U.S. Cl. ..... 204/147; 204/196

[58] Field of Search ..... 204/196, 147

[56] References Cited

U.S. PATENT DOCUMENTS

| | | | |
|---|---|---|---|
| 872,759 | 12/1907 | Schoneberger et al. | 204/196 |
| 3,497,434 | 2/1970 | Littauer | 204/196 |
| 3,661,742 | 5/1972 | Osborn et al. | 204/196 |
| 4,196,064 | 1/1980 | Harms et al. | 204/196 |
| 4,502,936 | 3/1985 | Hayfield | 204/196 |
| 4,767,512 | 8/1988 | Cowatch et al. | 204/196 |
| 4,772,344 | 9/1988 | Andoe | 204/147 |

*Primary Examiner*—John F. Niebling
*Assistant Examiner*—Steven P. Marquis
*Attorney, Agent, or Firm*—Oblon, Spivak, McClelland, Maier & Neustadt

[57] ABSTRACT

A device for preventing fouling organisms in seawater from attaching to the exposed surfaces of a marine vessel, buoy, oil rig platform, or other seawater structure. The antifouling device includes a zinc coating applied to the exposed surfaces of the seawater structure which are susceptible to fouling. When a small negative charge is impressed upon the seawater structure, a Helmholtz double layer forms at the interface between the zinc coating and the seawater which is precludes fouling. The slight negative charge impressed upon the zinc coating also prevents dissolution of the zinc into the seawater which would otherwise be expected.

22 Claims, 3 Drawing Sheets

ELECTROCHEMICAL SYSTEM FOR THE PREVENTION OF FOULING ON STEEL STRUCTURES IN SEAWATER

This is a continuation, of application Ser. No. 07/145,275, filed on Jan. 19, 1988.

FIELD OF THE INVENTION

The present invention relates generally to methods and apparatuses for preventing corrosion of metal and more particularly to a method and apparatus for preventing fouling of marine vessels, buoys, oil rig platforms, and other seawater structures.

BACKGROUND OF THE INVENTION

The present invention relates to an antifouling and anticorrosion device which applies a high voltage potential between a titanium anode and the conductive surface of the hull of a ship. The high voltage and the small current in the ship's submerged hull surface effectively prevents adherence of marine organisms to the hull while simultaneously preventing corrosion of the hull.

The shipping industry has long faced a serious problem caused by the adherence of marine organisms to ship hulls. Such fouling of a ship's hull increases the operating cost of a ship and decreases its efficiency. Marine organisms which become attached to the hull must periodically be removed, thereby usually taking the ship out of operation for extended periods of time for dry dock maintenance. Also, if fouling is not prevented, sea organisms will continue to attach to the hull and will cause ever increasing operating costs associated with additional fuel requirements and decreased speeds.

The prior art teaches several ways of removing marine organisms, including barnacle growth, from a ship. Barnacles can be mechanically scraped from the ship while in dry dock. Cleaning machines have been developed having rotating brushes which can remove barnacles and other marine organisms from the hull.

Another method of overcoming the fouling problem has been to use highly toxic paints on the hulls of ships. Such paints retard the build up of marine growth on the hull. A toxic element in the paint, such as a compound of copper or mercury which is soluble in seawater, is controllably dissolved into the water to provide protection over several years. For example U.S. Pat. No. 3,817,759 contemplates the use of an antifouling coating comprising a polymeric titanium ester of an aliphatic alcohol since titanium is known to have good corrosion resistance and low water solubility which prevents premature leaching and exhaustion of the coating.

Another antifouling method described in the prior art has been to coat the hull with a metallic paint whose ions are toxic to marine life, i.e., copper, mercury, silver, tin, arsenic, and cadmium, and then to periodically apply a voltage to the hull to anodically dissolve the toxic ions into the seawater thereby inhibiting marine life growth. This method is taught in U.S. Pat. No. 3,661,742 and in U.S. Pat. No. 3,497,434.

Antifouling systems which rely on dissolution of toxic paint into the seawater have limited utility since the coating applied to the hull is depleted and the hull must be periodically repainted. This problem is made even more severe in those systems which make the hull anodic to force dissolution since this increases the rate of dissolution. This poses a potentially serious problem since once the hull is exposed it to will be dissolved, resulting in pitting or puncturing of the hull.

Various other apparatuses have been proposed which rely upon application of a voltage to the hull of the ship or provision for flow of current through the hull of the ship to retard growth of marine organisms on the hull. Some systems have proposed the electro-chemical decomposition of seawater causing gases to be produced near the submerged surfaces of the hull. Proponents of such systems maintain that the gases prevent the adherence of marine organisms such as barnacles, algae, etc. Others suggest that high current can cause shock and retard the growth of marine organisms on the hull. None of these systems, however, have proven commercially successful for reasons of cost and poor antifouling results. Examples of these systems are disclosed in U.S. Pat. No. 4,196,064 and the Russian Patent No. 3388.

Solution to the problem of fouling requires a full understanding of the phenomenon involved. Fouling occurs especially on stationary structures and on ships in port, and there is relatively little fouling of a ship's hull while underway in the open sea. Although not understood in all respects, the phenomenon of fouling apparently is encouraged by bacteria and colloidal particles which in water solution possess an electric charge. For instance, amino acids are negatively charged and in combination as protein molecules are attracted to a ship's hull which is normally positive with respect to the protein molecules. These materials provide the elements of the marine organism food chain and form the initial film which appears on a ship's hull and attracts further sea creatures.

After formation of the initial phase of the food chain on the ship's hull, bacteria will form on the hull surface in one to three days, followed by an algae slime in three to seven days. Protozoans are observed within one to three weeks and finally barnacles attach to the hull in three to ten weeks. Interruption of the food chain will prevent adherence of marine organisms such as barnacles.

Another problem related to fouling of a ship's hull which the shipping industry has long attempted to solve is that of corrosion. Corrosion normally occurs to underwater portions of a ship's hull because the seawater acts as an electrolyte and current will consequently flow, as in a battery, between surface areas of differing electrical potential. The flow of current takes with it metal ions thereby gradually corroding anodic portions of the hull.

Various techniques have been developed to prevent corrosion. Sacrificial anodes of active metals such as zinc or magnesium have been fastened to the hull. Such anodes, through galvanic action, themselves corrode away instead of the hull. Other systems use cathodic protection by impressed current. Such systems utilize long life anodes which are attached to the hull to impress a current flow in the hull. The result is that the entire hull is made cathodic relative to the anode, thereby shielding it from corrosion. Such systems operate at very low voltage levels.

One cathodic protection system found in the prior art utilizes a titanium anode plated with platinum. The platinum acts as the electrical discharge surface for the anode into the electrolytic seawater. No current is discharged from any surface portions of the electrode comprising titanium. This particular system impresses high current densities on the anode on the order of 550 amps per square foot. Since there is a high current flow from the platinum or other non-soluble anode metal, there is a very low potential. There is essentially no current flow from the surface of the titanium. An example of such a system is disclosed in U.S. Pat. No. 3,313,721.

A titanium alloy has in another prior art system been used as a sacrificial anode. A pure titanium anode cannot be successfully used as a sacrificial anode because of the dielectric oxide layer which forms on its surface unless a quite high voltage is applied to it. In U.S. Pat. No. 3,033,775 a titanium alloy is used with such elements as cobalt, nickel, maganese, zinc, tin or the like to effect a lowering of the polarization potential of titanium thereby making it a good sacrificial anode. Indeed it has long been recognized that pure titanium does not perform satisfactorily as a soluble or sacrificial anode material because of the electrically resistant oxide film that forms on its surface.

A final problem faced by those desiring to develop a successful antifouling system is hydrogen embrittlement of the ship's hull. When electrolytic action takes place close to the surface of the ship's hull, such as in some of those systems described above, hydrolysis of the seawater may occur. Such hydrolysis releases hydrogen ions which cause embrittlement of the ship's hull. Consequently, it is important in any antifouling system which is installed that the system not be operated at such high currents to cause hydrolysis of the water thereby releasing hydrogen. This problem has prevented others in the art from developing a high voltage antifouling device which can successfully prevent the adherence of marine organisms without causing hydrogen embrittlement.

SUMMARY AND OBJECTS OF THE INVENTION

The present invention prevents fouling of a ship's hull with barnacles and other marine organisms by impressing a negative charge on the hull of the ship which is coated with an inorganic zinc paint and permitting only a small current flow. Because of the presence of charge on the zinc coating, a Helmholtz double layer will form at the zinc/seawater interface. The innermost Helmholtz plane contains a high concentration of positively charged ions, most notably zinc and sodium. The outer Helmholtz plane consists of negatively charged ions, a relatively high concentration of which are hydroxyl ions. The negative hydroxyl ions in the outer Helmholtz plane are attracted to the positively charged zinc and sodium ions in the inner Helmholtz plane to form a caustic solution which destroys and/or repels the lower organisms of the fouling community. This prevents succession and attachment of higher organisms such as barnacles and tube worms.

The antifouling system described herein has many advantages over prior art devices. First, a negative potential is applied to the ship's hull rather than a positive potential so that there is only negligible dissolution of the coating. This eliminates the necessity for repainting the ship's hull periodically. Secondly, while cathodic protection systems for preventing corrosion are known, they always employ external anodes. The present invention incorporates an internal electrode which was not previously thought to be practical. Thirdly, prior art devices using current to prevent fouling have typically involved high current densities so they cause hydrogen embrittlement of the hull and are expensive to operate. The present invention avoids these problems since it utilizes extremely low current densities with relatively high potential difference between the hull and the titanium electrode.

Accordingly, it is a primary object of the present invention to provide an electrochemical system which prevents fouling organisms in the seawater from adhering to the exposed surfaces of a seawater structure.

Another object of the present invention is to provide an electrochemical system of the type described above which applies a negative potential to the hull to avoid dissolution of the zinc coating thereby obviating the need for repainting the hull at periodic intervals.

Another object of the present invention is to provide an electrochemical system of the type described above which utilizes internal electrodes which are less susceptible to damage.

Another object of the present invention is to provide an electrochemical system of the type described above which utilizes low current densities on the seawater structure so as to avoid hydrogen embrittlement.

Still another object of the present invention is to provide an electrochemical system of the type described above which prevents corrosion of the seawater structure.

Other objects and advantages of the present invention will become apparent and obvious from a study of the following description and the accompanying drawings which are merely illustrative of such invention.

DETAILED DESCRIPTION OF THE INVENTION

Figure 1:
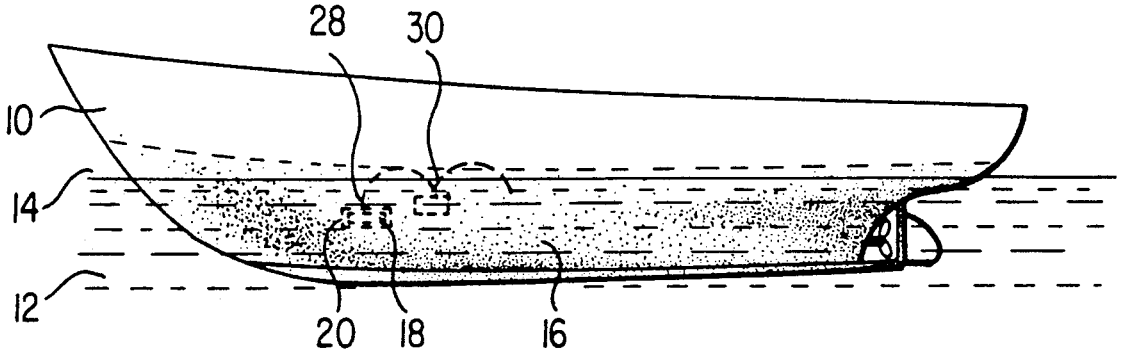
FIG. 1 is an elevation of a ship equipped with the antifouling device of the present invention.

The preferred embodiment of the present invention is illustrated therein. In FIG. 1 there is shown a view of the ship's hull 10 on which the antifouling system of the present invention is at least partially submerged in seawater or brackish water 12. The exposed surface of the ship's hull 10 below the water line 14 is susceptible to fouling, which occurs as a succession. First, dissolved nutrients in the seawater aggregate by Vander Waals forces upon the exposed surface. Bacteria in the marine environment are chemotropically attracted to the adsorbed nutrients and form a bacterial slime layer of discernible thickness. The bacterial slime layer is then infiltrated by diatoms, algae, and other single celled organisms. The more sessile organisms, such as barnacles and tube worms, feed upon the diatoms, algae, etc., and attach permanently to the nutrient rich surface. These last animals and plants, which are large in volume, are commonly thought of as the "fouling" on ship's hulls, buoys, and other submerged structures.

The present invention prevents fouling by breaking the chain from dissolved nutrients to higher plants and animals. The exposed surface of the ship's hull 10 is coated with a predominantly zinc coating 16 upon which is impressed a small negative current. A Helmholtz double layer forms at the surface/seawater interface which precludes the lower organisms of the fouling community from adhering to the exposed surfaces.

The ship's hull 10 is first sandblasted to white steel to remove oxides and produce a reactive surface. While in a reactive state, a zinc rich inorganic paint is applied to the steel hull 10 to form a predominantly zinc coating 16. A dry film coat having a zinc content of 82 to 97 percent is preferred. The zinc coating 16 forms an inferfacial layer between the seawater 12 and the ship's hull 10 and is bonded to the iron in the ship's hull 10. Inorganic zinc coatings suitable for practicing the present invention are of the alkyl silicate or the alkali hydrolyzed type which are commercially readily available. One such commercially available paint is Carbozinc 11 manufactured by Carboline, Inc.

Figure 2:
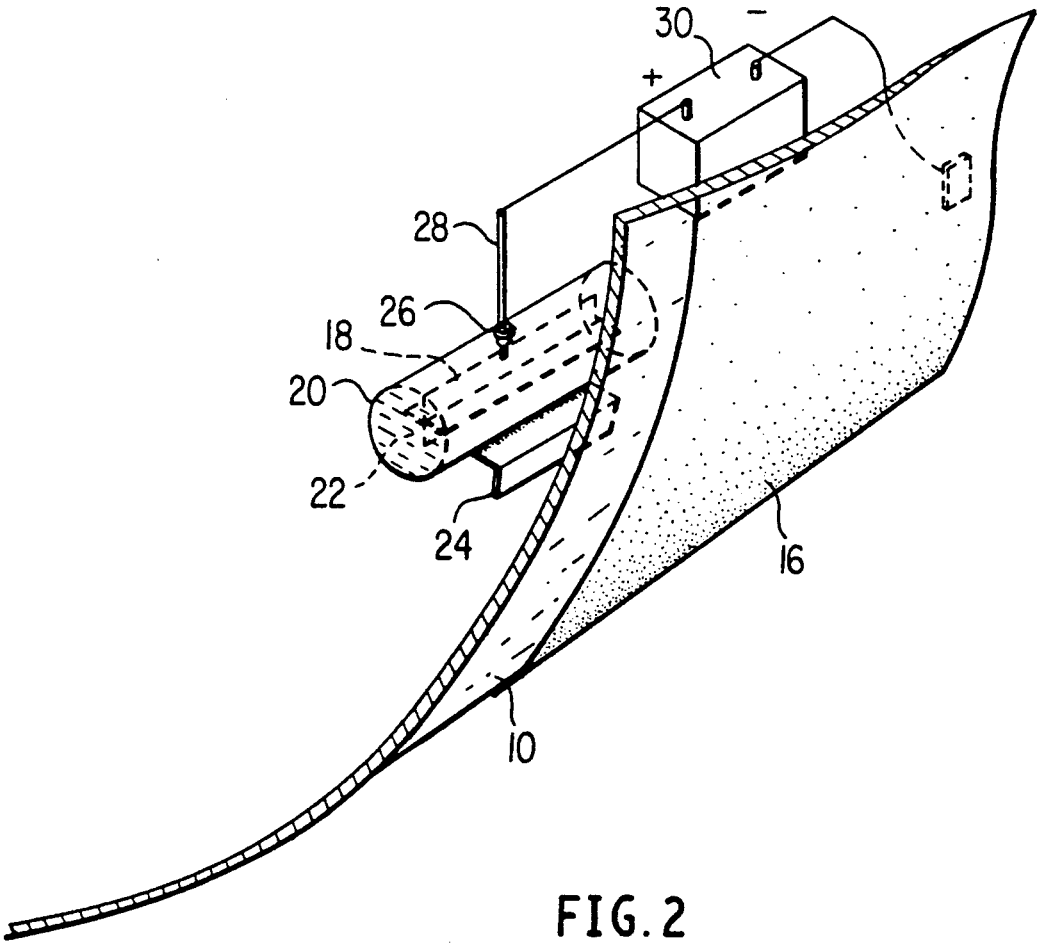
FIG. 2 is a perspective view of the internal electrode.
Figure 5:
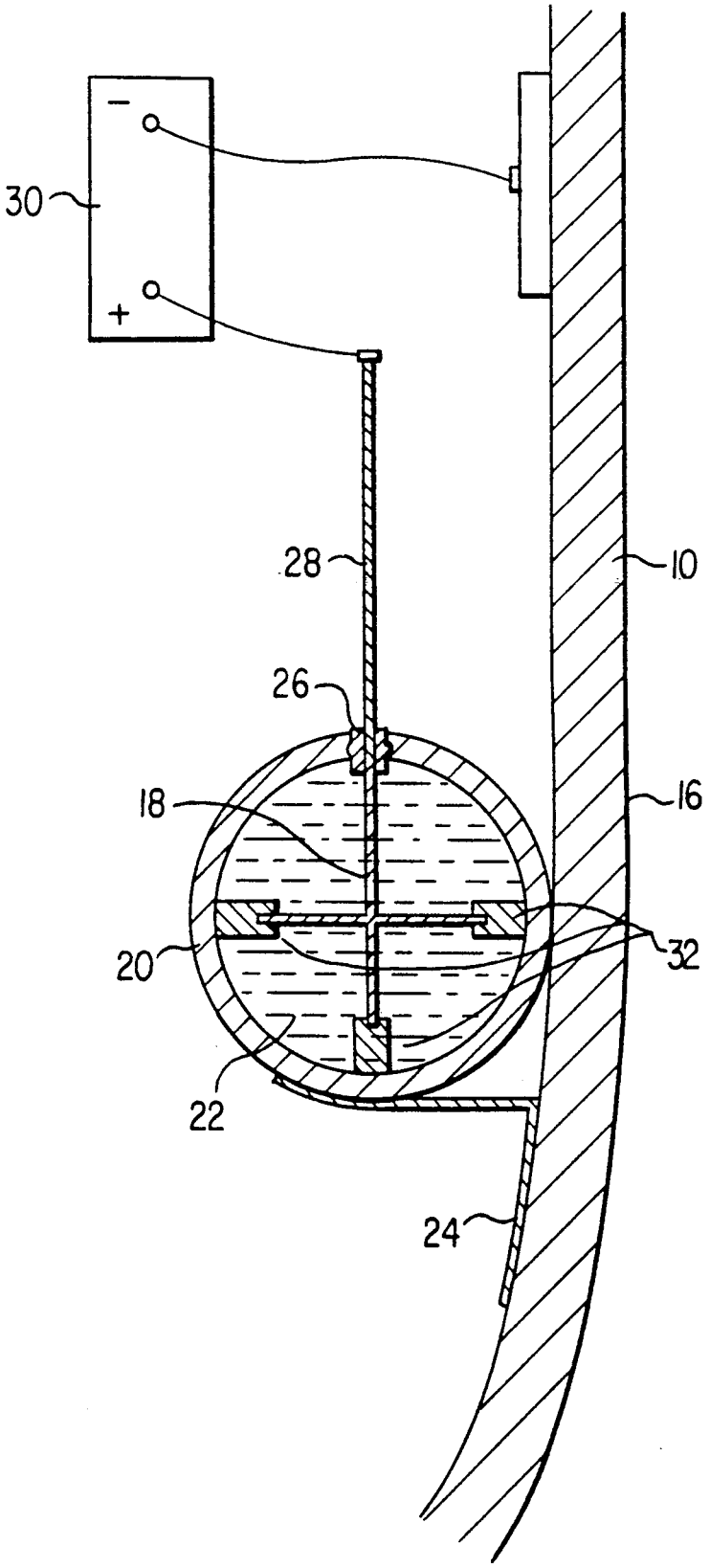
FIG. 5 is a section view of the titanium electrode.

In the preferred embodiment of the invention, one or more titanium electrodes 18 are disposed within the ship's hull 10 and are capacitatively coupled to form a large electrolytic capacitor in which the ship's hull 10 functions as a negative plate. As seen in FIGS. 2 and 5, the titanium electrodes 18 are mounted on insulators 32 within a conductive hollow body 20 filled with a liquid electrolyte 22. The hollow body 20 is secured to the ship's hull 10 by a conductive mount 24.

An insulated thru-hull fitting 26 penetrates the hollow body 20 and forms a water tight seal. The fitting 26 provides an insulated conduit through the hollow body 20. A titanium rod 28 of similar alloy as the titanium electrode 18 extends through the fitting 26 and is connected to the electrode 18.

A power supply 30 is connected to the titanium rod 28 and the conductive surface of the ship's hull 10. Power supply 30 preferrably provides a potential difference of eight or more volts DC. The positive terminal of the power supply is connected to the titanium rod 28 externally of the hollow body 20 and the negative terminal is connected to the ship's hull 10. When the submerged surface area of the hull 10 is large, a plurality of contacts from the negative terminal of the power supply 30 to spaced apart points on the hull 10 may be required to assure a proper potential gradient across the entire surface.

Upon imposition of a positive charge, a titanium film forms on the surface of the titanium electrode 18 which is only several angstroms thick and is in intimate contact with the titanium electrodes 18. The oxide film acts as a dielectric insulator to limit current flow between the ship's hull 10 and the titanium electrode 18. This oxide film can have a dielectric constant of up to 100.

It is known that aluminum and magnesium also will form an oxide film in manner similar to titanium. However, such oxide films are much thinner and consequently, fail to operate as effectively to limit current. If a titanium electrode 18 is used, liquid electrolytes containing small ions such as bromides, chlorides, and florides should be avoided since they may pierce the oxide film.

As embodied herein, the entire system acts as a large electrolytic capacitor. The titanium electrode 18 functions as the positive plate with an impressed positive charge. The ship's hull 10 and the electrolyte 22 act as the negative plate with an impressed negative charge. The electrolyte 22 effectively moves the ship's hull 10 into close proximity to the titanium oxide dielectric creating a capacitative relationship between the electrode 28 and the ship's hull 10. The oxide film which is formed on the titanium electrode 18, functions as the dielectric of the capacitor. Because of the dielectric effect of the oxide film, a relatively high potential difference can be applied between the ship's hull 10 and the titanium electrode 18 while permitting only a small controllable current leakage. In the present system the potential difference between the titanium electrode and the ship's hull 10 is approximately 8 to 10 volts. A half-cell voltage of approximately 0.9 to 1.2 negative volts DC measured from the ship's hull 10 to a silver-silver chloride reference cell is achieved. Current densities in the range of 4 to 8 $mA/ft^2$ are preferred. At these levels, there is sufficient energy to ionize seawater without evolving sufficient free hydrogen at the zinc/seawater interface to cause hydrogen embrittlement of the hull.

Figure 3:
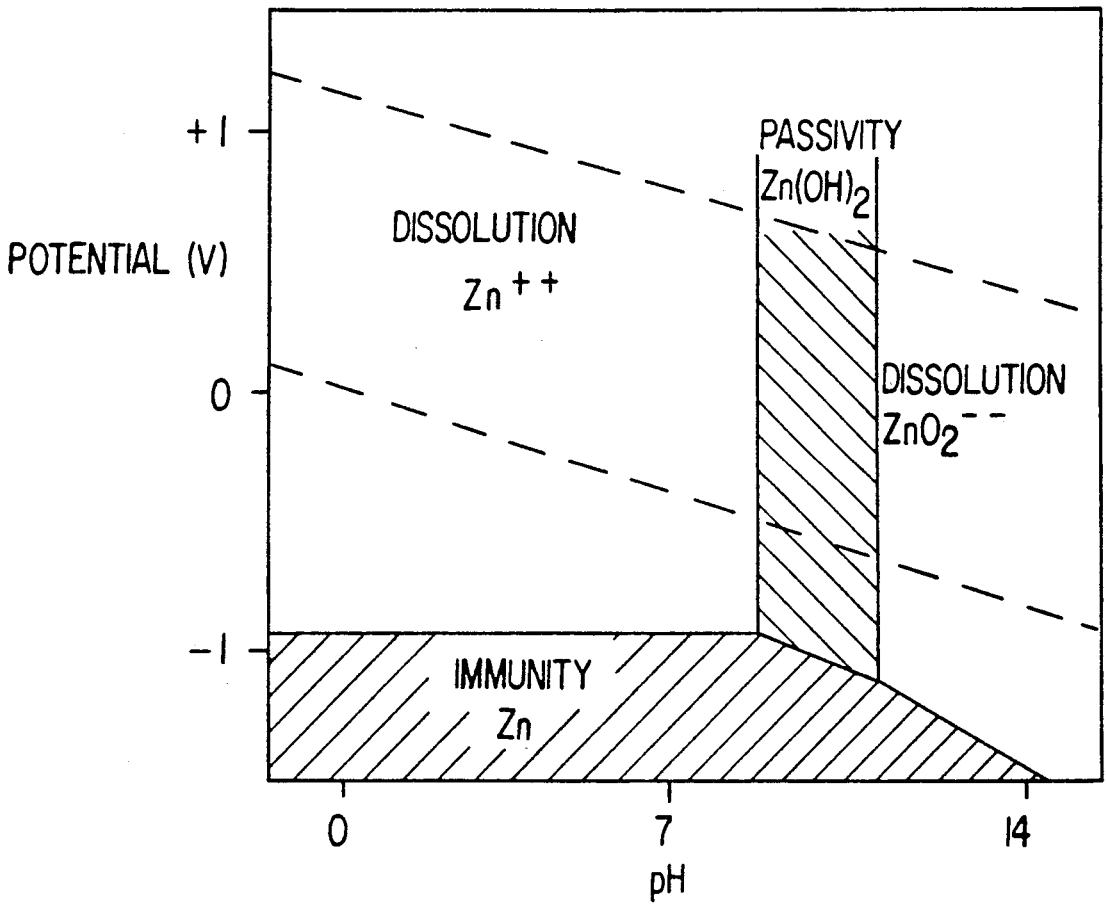
FIG. 3 is a Pourbaix diagram for zinc.

The negative charge impressed upon the ship's hull 10 and the conductively coupled zinc coating 16 causes limited electrolytic disassociation of water into hydrogen ions and hydroxyl ions. The hydroxyl ions combine with zinc ions oxided from the zinc coating 16 but prevented from escaping by the ph level and the impressed charge. The resultant, zinc hydroxide, raises the ph level of the seawater from 7 to somewhere between 8 and 11 which is in the passivity range of zinc as shown in the Pourbaix diagram of FIG. 3. This effectively prevents dissolution of the zinc coating 16 into the seawater.

Figure 4:
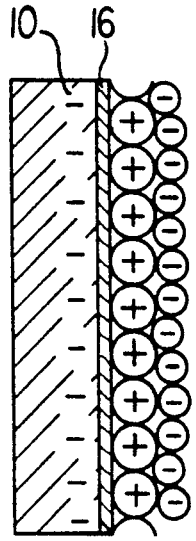
FIG. 4 is a schematic diagram showing the Helmholtz double-layer which develops at the interface between the ship's hull and the seawater.

At the zinc/seawater interface there is developed a Helmholtz double layer. See FIG. 4. Within the innermost Helmholtz plane is a concentration of positively charged metallic ions disassociated from the adjacent seawater, i.e., calcium; magnesium; sodium; and zinc. Within the outermost Helmholtz plane, there is a concentration of negatively charged ions which are also disassociated from the seawater including hydroxyls in chloride. The hydroxyl ions in the outermost Helmholtz plane are chemically attracted to the zinc and sodium ions in the innermost Helmholtz plane and form a caustic solution that prevents adherence of fouling organisms.

The present invention prevents the development of the bacterial slime in two ways; one chemically oriented and one tropism oriented. It has been demonstrated that most bacterial cells possess a negative surface charge which, when placed in an electrical field, causes them to migrate away from the negative end. In the system embodied herein, the negative surface charge of the outer Helmholtz plane repels not only bacteria but many higher organisms in the food chain. Such organisms are not harmed by the negative charge, but are simply repelled and avoid the area in which they sense the effects.

The chemical effect upon fouling organisms has three major facets: saponaceous; osmotic; and poisonous. In the first case, the surface of the zinc is maintained at a ph level approaching 11. At this level of hydroxyl concentration, the lipid content of the bacterial cell reacts with sodium hydroxide, thus, destroying the bacterial capsule and killing the bacteria and other similar one-celled organisms. Secondly, there is a concentration of positive ions tightly bound to the zinc coating 16 as a result of the negative attraction of the coating 16. This results in higher concentrations of metallic ion salts. When a microorganism enters the inner Helmholtz plane, the salts have a negative osmotic effect and withdraw cellular fluid, thus, "salting out" the cell proteins and causing death of the organism. While some organisms in seawater can tolerate high osmotic pressures, they are not usually in the fouling community. Lastly, as salts of a heavy metal, zinc salts are capable of combining with and poisoning cellular protein. The toxic effect of zinc, however, is somewhat speculative since zinc has never been proven to be toxic as a coating in seawater.

Whatever the antifouling mechanism, it is apparent that a zinc coated surface submerged in seawater is resistant to fouling when impressed with a net negative potential contrary to prior teachings. Zinc alone has no antifouling affect. This was demonstrated in experiments where a test structure was coated with a zinc rich paint and submerged in seawater. The test structure, without any negative charge impressed, fouled heavily.

For purposes of providing a better understanding of the invention, the following illustrative examples are given:

EXAMPLE 1

A buoy was constructed from a section of black cold-rolled steel, was covered with a zinc rich paint. A titanium electrode similar to that shown in FIGS. 2 and 5 was housed within an internal pipe electrically connected to the larger pipe. Within the smaller pipe was a placed a strip of titanium some six inches long by two inches wide which was insulated from the internal pipe. The internal pipe was filled with an electrolytic solution consisting of 50 percent propylene glycol and 50 percent distilled (deionized) water. To this solution was added ammonium nitrate at the rate of one gram per liter. An eight volt potential difference between the titanium electrode and the external pipe was impressed upon the assembly which was placed in the water in Bogue Sound at Morehead City. Extensive fouling was noted on the cables used to secure the buoys, however, no appreciable fouling was found on the zinc coated surfaces.

EXAMPLE 2

A control buoy was installed, which, although zinc coated, had no titanium electrode and no impressed potential. The control buoy was placed in the water at the same location as the assembly described in Example 1 and was left for the same period of time. The control buoy was extensively fouled proving that inorganic zinc rich paint itself is not an antifoulant.

EXAMPLE 3

In this experiment a test buoy was constructed identical to that described in example one except the buoy was not coated. The test buoy was placed in the water at the same location as the previous two assemblies and was left for the same period of time. Although a negative potential between the electrode and the surface of the buoy was impressed, the buoy was extensively fouled indicating that a charge on a metal surface alone will not prevent fouling.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A system for preventing fouling or corrosion of a surface or surfaces of a marine structure in contact with a water environment, said marine structure having an interior surface and an exterior surface, said system comprising:

(a) a conductive zinc coating in conductive contact with at least part of said exterior surface, wherein when said marine structure is in contact with said water environment, said conductive zinc coating forms an interfacial layer between said exterior surface and said water environment; and (b) means for inducing and maintaining a negative capacitive charge on said conductive zinc coating sufficient to prevent fouling or corrosion of said exterior surface when said exterior surface is in contact with said water environment, said means comprising a power supply having a terminal of a first polarity conductively connected to said exterior surface and a terminal of opposite polarity capacitively connected to said exterior surface, said power supply and said capacitive connection means being both protected from contact by said water environment.

2. The system of claim 1, wherein said marine structure is a ship.

3. The system of claim 1, wherein said water environment is a sea water environment.

4. The system of claim 3, wherein said means for inducing and maintaining a negative capacitive charge includes means for maintaining a current density on said marine structure sufficient to cause a limited dissociation of said sea water and form zinc hydroxide and sodium hydroxide adjacent to said interfacial layer without evolving hydrogen.

5. The system of claim 4, wherein said current density is within the range of approximately 4 to approximately 8 mA $ft^{-2}$.

6. The system of claim 1, wherein said capacitive connection means comprises a conductive body conductively connected to said exterior surface filled with a liquid electrolyte, and a conductor means insulatively mounted within said hollow body and substantially surrounded by said liquid electrolyte.

7. The system of claim 6, wherein said conductor means is predominantly titanium and forms a titanium oxide film of up to a dielectric constant of 100 when placed in said liquid electrolyte and charged positively.

8. A system for preventing fouling or corrosion of a surface or surfaces of a marine structure in contact with a water environment, said marine structure having an interior surface and an exterior surface, said system comprising:

(a) a conductive zinc coating in conductive contact with at least part of said exterior surface, wherein when said marine structure is in contact with said water environment, said conductive zinc coating forms an interfacial layer between said exterior surface and said water environment; and (b) means for inducing and maintaining a negative capacitive charge on said conductive zinc coating sufficient to prevent fouling or corrosion of said exterior surface when said exterior surface is in contact with said water environment, said means comprising a power supply having a terminal of a first polarity conductively connected to said exterior surface and a terminal of opposite polarity capacitively connected to said exterior surface, said power supply and said capacitive connection means being both situated in the interior of said marine structure.

9. The system of claim 8, wherein said water environment is a sea water environment.

10. The system of claim 9, wherein said means for inducing and maintaining a negative capacitive charge includes means for maintaining a current density on said marine structure sufficient to cause a limited dissociation of said sea water and form zinc hydroxide and sodium hydroxide adjacent to said interfacial layer without evolving hydrogen.

11. The system of claim 10, wherein said current density is within the range of approximately 4 to approximately 8 mA $ft^{-2}$.

12. The system of claim 8, wherein said capacitive connection means comprises a conductive body conductively connected to said exterior surface filled with a liquid electrolyte, and a conductor means insulatively mounted within said hollow body and substantially surrounded by said liquid electrolyte.

13. The system of claim 12, wherein said conductor means is predominantly titanium and forms a titanium oxide film of up to a dielectric constant of 100 when placed in said liquid electrolyte and charged positively.

14. The system of claim 8, wherein said marine structure is a ship.

15. A method for preventing fouling or corrosion of a surface or surfaces of a marine structure in contact with a water environment, said marine structure having an interior surface and an exterior surface, said method comprising inducing and maintaining a negative capacitive charge on a conductive zinc coating in conductive contact with at least part of said exterior surface and forming an interfacial layer between said exterior surface and said water, said negative capacitive charge being sufficient to prevent said fouling or said corrosion, wherein said negative capacitive charge is induced and maintained by a means comprising a power supply having a terminal of a first polarity conductively connected to said exterior surface and a terminal of opposite polarity capacitively connected to said exterior surface, wherein said power supply and said capacitive connection means are both protected from contact by said water environment.

16. The method of claim 15, wherein said marine structure is a ship.

17. The method of claim 15, wherein said water environment is a sea water environment.

18. The method of claim 17, wherein said means for inducing and maintaining a negative capacitive charge includes means for maintaining a current density on said marine structure sufficient to cause a limited dissociation of said sea water and form zinc hydroxide and sodium hydroxide adjacent to said interfacial layer without evolving hydrogen.

19. The method of claim 18, wherein said current density is within the range of approximately 4 to approximately 8 mA $ft^{-2}$.

20. The method of claim 15, wherein said capacitive connection means comprises a conductive body conductively connected to said exterior surface filled with a liquid electrolyte, and a conductor means insulatively mounted within said hollow body and substantially surrounded by said liquid electrolyte.

21. The method of claim 20, wherein said conductor means is predominantly titanium and forms a titanium oxide film of up to a dielectric constant of 100 when placed in said liquid electrolyte and charged positively.

22. A method for preventing fouling or corrosion of a surface or surfaces of a marine structure in contact with a water environment, said marine structure having an interior surface and an exterior surface, said method comprising inducing and maintaining a negative capacitive charge on a conductive zinc coating in conductive contact with at least part of said exterior surface and forming an interfacial layer between said exterior surface and said water, said negative capacitive charge being sufficient to prevent said fouling or said corrosion, wherein said negative capacitive charge is induced and maintained by a means comprising a power supply having a terminal of a first polarity conductively connected to said exterior surface and a terminal of opposite polarity capacitively connected to said exterior surface, wherein said power supply and said capacitive connection means are both situated in the interior of said structure.

* * * * *